US008317124B2

(12) United States Patent
Yu Chen

(10) Patent No.: US 8,317,124 B2
(45) **Date of Patent: *Nov. 27, 2012**

(54) FILM PACKING DEVICE

(76) Inventor: Hsiu-Man Yu Chen, Tan Tzu Township, Taichung County (TW)

( * ) Notice: Subject to any disclaimer, the term of this patent is extended or adjusted under 35 U.S.C. 154(b) by 173 days.

This patent is subject to a terminal disclaimer.

(21) Appl. No.: 12/729,592

(22) Filed: Mar. 23, 2010

(65) Prior Publication Data

US 2011/0233321 A1 Sep. 29, 2011

(51) Int. Cl.
*B65H 75/38* (2006.01)

(52) U.S. Cl. ..... 242/599.1; 242/588.6; 242/599.4

(58) Field of Classification Search ..... 242/588, 242/588.3, 588.6, 596.4, 599, 599.1, 599.3, 242/599.4, 605
See application file for complete search history.

(56) References Cited

U.S. PATENT DOCUMENTS

| | | | | | |
|---|---|---|---|---|---|
| 689,834 | A * | 12/1901 | Tilton | ..... | 242/599.2 |
| 1,080,229 | A * | 12/1913 | Nelson | ..... | 242/599.3 |
| 4,102,513 | A * | 7/1978 | Guard | ..... | 242/588 |
| 4,166,589 | A * | 9/1979 | Hoover et al. | ..... | 242/588 |
| 5,779,179 | A * | 7/1998 | Zentmyer et al. | ..... | 242/423.2 |
| 6,883,298 | B2 * | 4/2005 | Gooding et al. | ..... | 242/588.6 |
| 6,920,742 | B1 * | 7/2005 | Yu Chen | ..... | 242/588.2 |
| 7,228,677 | B2 * | 6/2007 | Yu Chen | ..... | 242/586.2 |
| 7,762,490 | B1 * | 7/2010 | Yu Chen | ..... | 242/405.2 |

* cited by examiner

*Primary Examiner* — William A Rivera
(74) *Attorney, Agent, or Firm* — Ming Chow; Sinorica, LLC

(57) ABSTRACT

A film packing device has a handle. The handle is pivotally connected with a film packing unit and a roller unit. The film packing unit has an axle tube, a first rolling member and a second rolling member. A roll of film is fitted on the axle tube with the axle tube to provide a support effect for the user to pack an object in a quick, simply and convenient way.

7 Claims, 7 Drawing Sheets

FILM PACKING DEVICE

BACKGROUND OF THE INVENTION

1. Field of the Invention

The present invention relates to a film packing device for a roll of film which does not have a reel therein.

2. Description of the Prior Art

In order to avoid an article from falling during transportation, a roll of film is used to pack the article for providing a secure effect. In general, a film reel made of paper is provided in the roll of film. The user uses a film packing device to connect with two sides of the roll of film for packing. To consider the environmental protection, the roll of film is designed to be one without a reel. There is no support for the roll of film. The conventional film packing device can not fix the two ends of the roll of film securely, casing a little trouble to the user. This is unfavorable for packing. Accordingly, the inventor of the present invention has devoted himself based on his many years of practical experiences to solve this problem.

SUMMARY OF THE INVENTION

The present invention is to provide a film packing device comprising a handle. The handle has a first connection rod and a second connection rod at two lateral ends thereof. A film packing unit and a roller unit are provided between the first connection rod and the second connection rod. The film packing unit comprises an axle tube, a first rolling member and a second rolling member. The axle tube has a first positioning portion and a second positioning portion at two ends thereof. One end of the first rolling member has a first connecting portion corresponding to the first positioning portion of the axle tube to connect with the axle tube. The other end of the first rolling member is connected with a quick-release member. The first rolling member is pivotally connected to the first connection rod through the quick-release member. One end of the second rolling member has a second connecting portion corresponding to the second positioning portion of the axle tube to connect with the axle tube. The other end of the second rolling member is connected with a pivot member. The second rolling member is pivotally connected to the second connection rod through the pivot member. A roll of film is fitted on the axle tube with the axle tube to provide a support effect for the user to pack an object in a quick, simply and convenient way.

DETAILED DESCRIPTION OF THE PREFERRED EMBODIMENTS

Embodiments of the present invention will now be described, by way of example only, with reference to the accompanying drawings.

Figure 1:
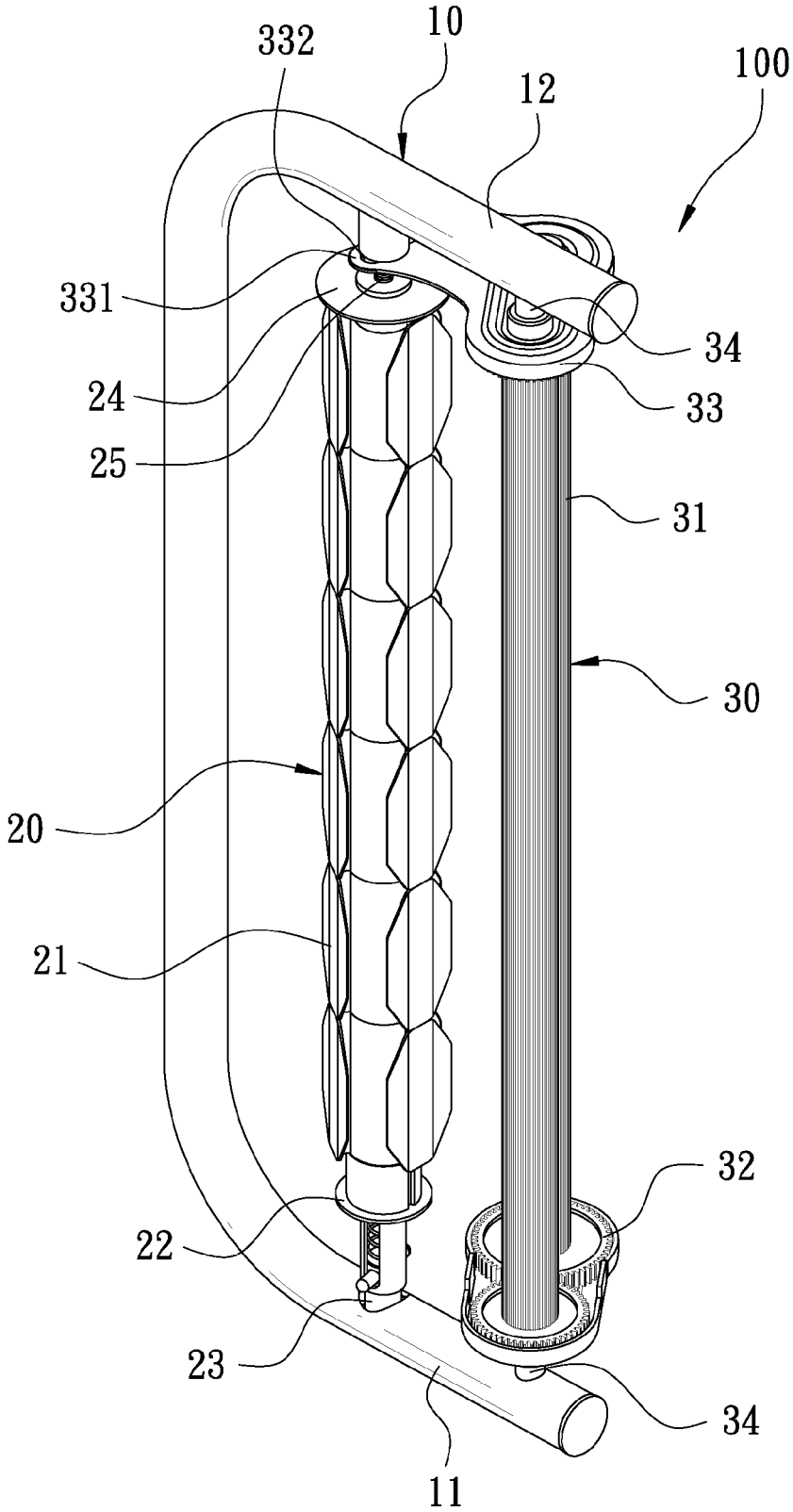
FIG. 1 is a perspective view according to a preferred embodiment of the present invention.
Figure 2:
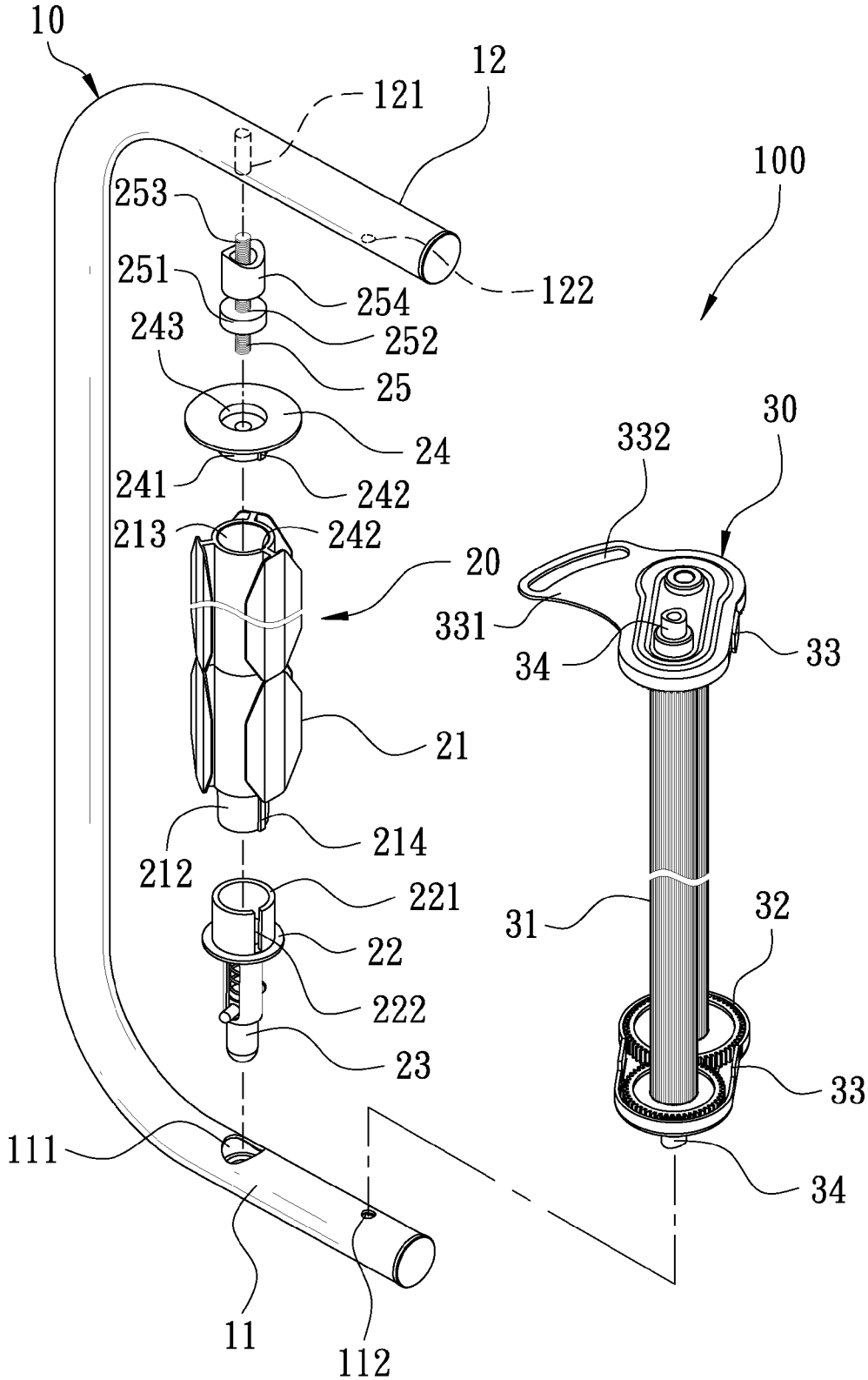
FIG. 2 is an exploded view according to the preferred embodiment of the present invention.
Figure 3:
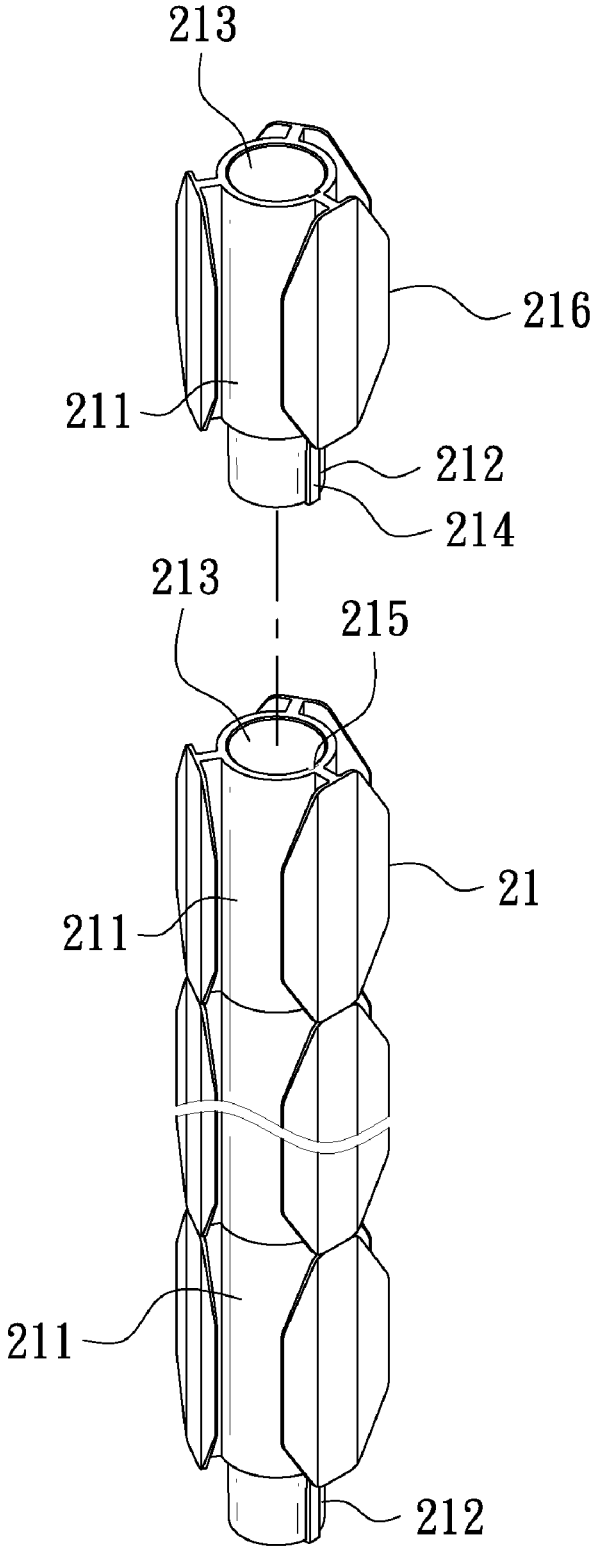
FIG. 3 is a partially perspective view showing the axle tube according to the preferred embodiment of the present invention.

As shown in FIGS. 1 to 3, a film packing device 100 according to a preferred embodiment of the present invention comprises a handle 10 and a film packing unit 20.

The handle 10 has a first connection rod 11 and a second connection rod 12 at two lateral ends thereof. The first connection rod 11 has a first positioning hole 111 and a first fixing hole 112 thereon. The second connection rod 12 has a second positioning hole 121 corresponding in position to the first positioning hole 111 and a second fixing hole 122 corresponding in positioning to the first fixing hole 112.

The film packing unit 20 is disposed between the first connection rod 11 and the second connection rod 12. The film packing unit 20 comprises an axle tube 21, a first rolling member 22, a quick-release member 23, a second rolling member 24, and a pivot member 25.

The axle tube 21 can be formed in one-piece or composed of a plurality of sleeves 211 which are connected one by one, as shown in FIG. 3. Each sleeve 211 has a first positioning portion 211 at one end thereof and a second positioning portion 213 at an opposing end thereof. With the first positioning portion 212 and the second positioning portion 213, the sleeves 211 are connected together to form the axle tube 21. Two ends of the axle tube 21 are formed with the first positioning portion 212 and the second positioning portion 213, respectively. In this embodiment, the first positioning portion 212 is a protruding ring. The first positioning portion 212 has a positioning block 214 on an outer surface thereof. The second positioning portion 213 is a trough. The second positioning portion 213 has a limit groove 215 on an inner wall thereof to connect with the first positioning portion 212. Each sleeve 211 further includes three tightening pieces 216 thereon, so that the axle tube 21 has a number of tightening pieces 216 thereon.

Figure 4:
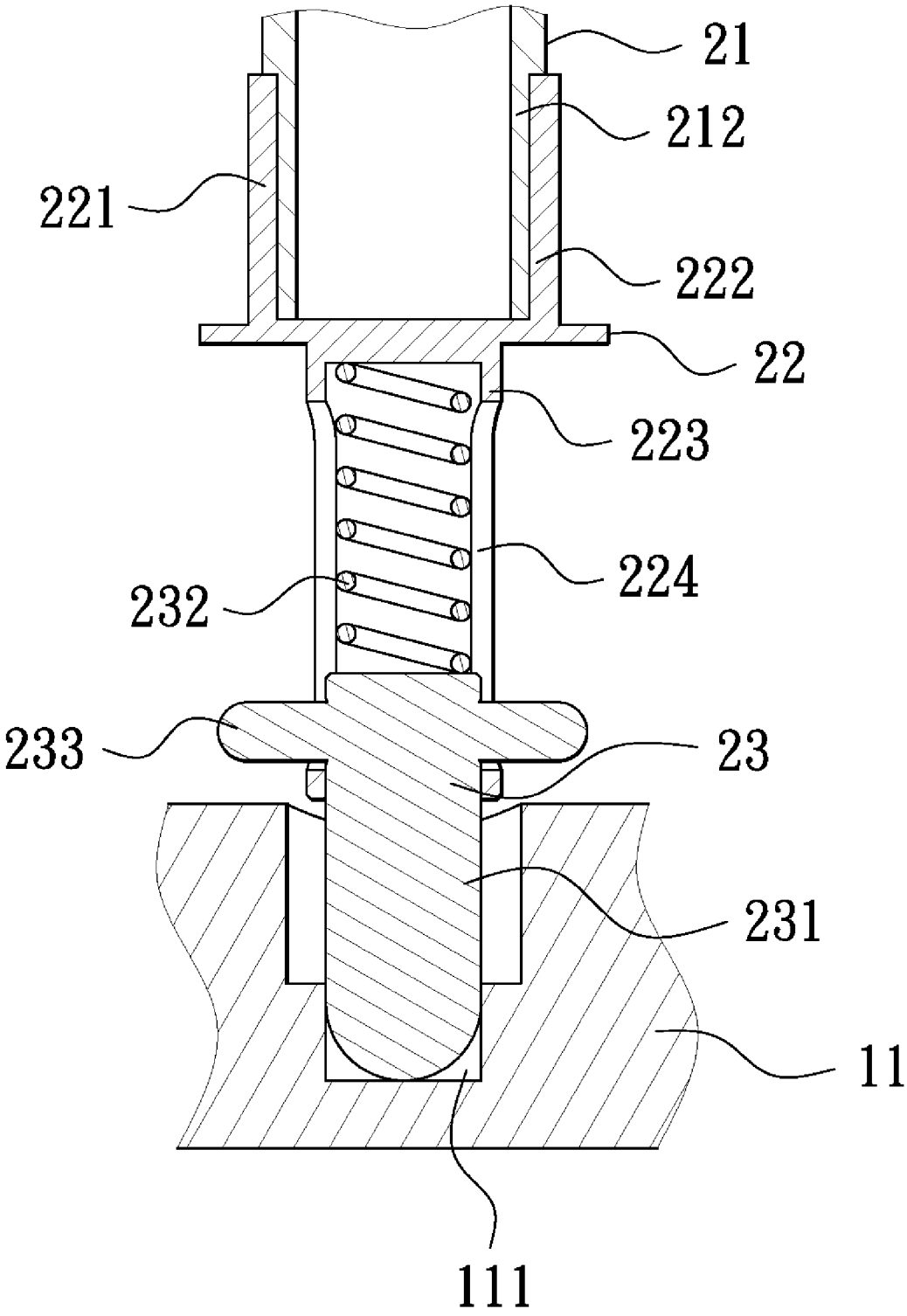
FIG. 4 is a partially enlarged cross-sectional view showing the first rolling member according to the preferred embodiment of the present invention.

Referring to FIG. 4, one end of the first rolling member 22 has a first connecting portion 221 corresponding to the first positioning portion 212 of the axle tube 21. The first connecting portion 221 is a trough. The first connecting portion 221 has a positioning groove 222 thereon to connect with the first positioning portion 212 of the axle tube 21. The other end of the first rolling member 22 has a protruding ring 223 corresponding to the first positioning hole 111 of the handle 10. The protruding ring 223 has two slots 224 thereon. The quick-release member 23 is disposed in the protruding ring 223. The quick-release member 23 includes a fixing rod 231 and a spring 232 which is located between a bottom of the protruding ring 223 and the fixing rod 231. One end of the fixing rod 231, opposite to the spring 232, is extended out the protruding ring 223 by the spring 232 and inserted in the first positioning hole 111, such that the first rolling member 22 is pivotally connected to the first connection rod 11. The fixing rod 231 has two limit levers 233 at two sides thereof corresponding to the two slots 224 for the user to apply force.

Figure 5:
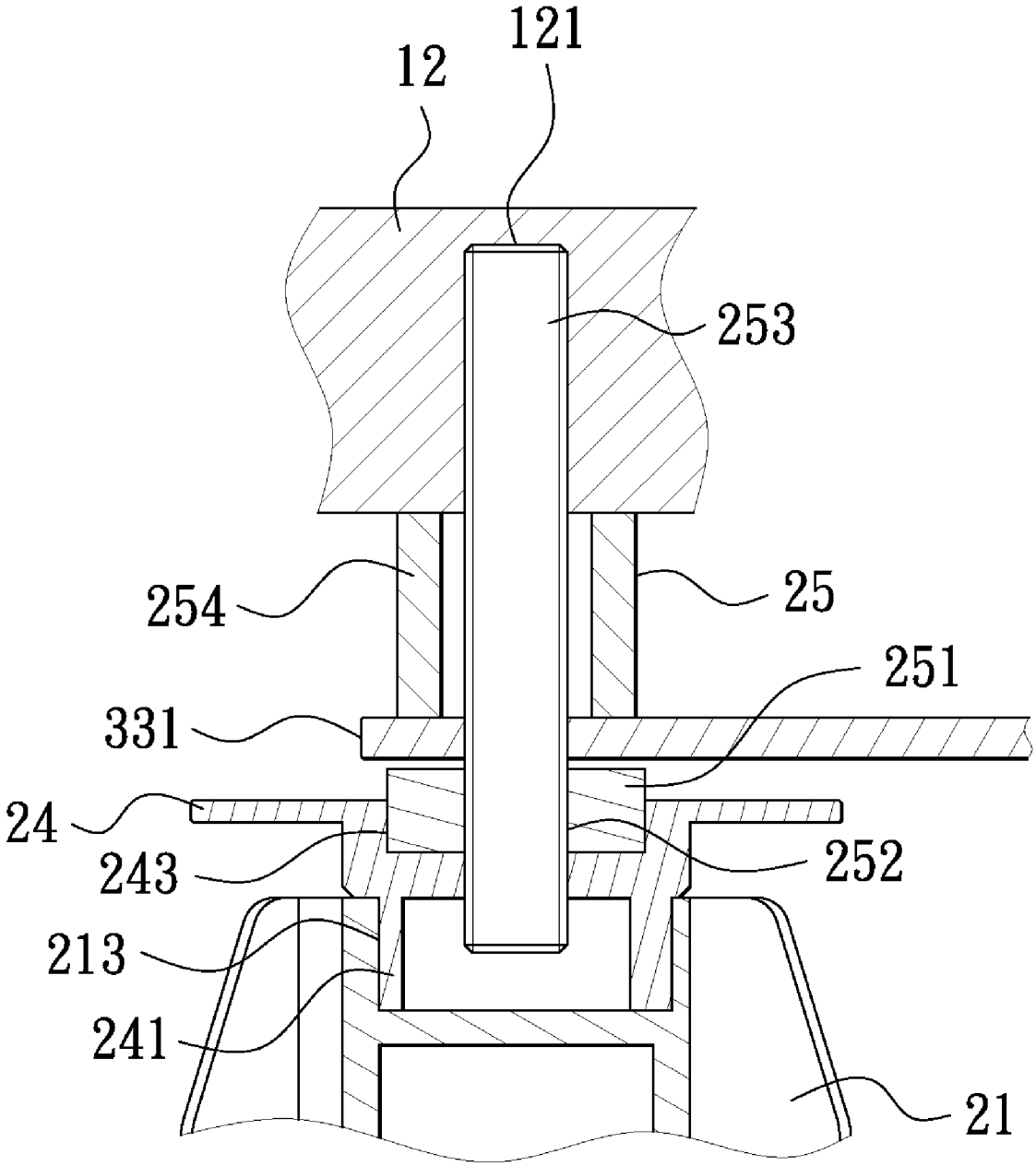
FIG. 5 is a partially enlarged cross-sectional view showing the second rolling member according to the preferred embodiment of the present invention.

Referring to FIG. 5, one end of the second rolling member 24 has a second connecting portion 241 corresponding to the second positioning portion 213 of the axle tube 21. The second connecting portion 241 is a protruding ring. The second connecting portion 241 has a limit block 242 thereon to connect with the second positioning portion 213 of the axle tube 21. The other end of the second rolling member 24 has a circular trough 243 to connect with the pivot member 25. The pivot member 25 includes a pivot block 251 received in the circular trough 243. The pivot block 251 is rotatable in the circular trough 243. The pivot block 251 has a threaded hole 252 for insertion of a pivot rod 253. One end of the pivot rod 253, opposite to the pivot block 251, is provided with a stop block 254 and inserted in the second positioning hole 121, such that the second rolling member 24 is pivotally connected to the second connection rod 12.

In addition, the film packing device 100 further comprises a roller unit 30 which is disposed between the first connection rod 11 and the second connection rod 12. The roller unit 30 has two rollers 31. Two ends of each of the rollers 31 are provided with gears 32 to mesh with each other, so that the rollers 31 are driven to rotate. An outer side of the gears 32 is provided with a casing 33. One end of the casing 33 is provided with a connection shaft 34 to be inserted in the first fixing hole 112 of the first connection rod 11 and the second fixing hole 122 of the second connection rod 12, respectively. The casing 33 close to the second rolling member 24 has one side formed with an extension portion 331. The extension portion 331 has a guide groove 332 thereon. The guide groove 332 is connected between the pivot block 251 and the stop block 254 of the pivot member 25 to confine the turning of the roller unit 30.

Figure 6:
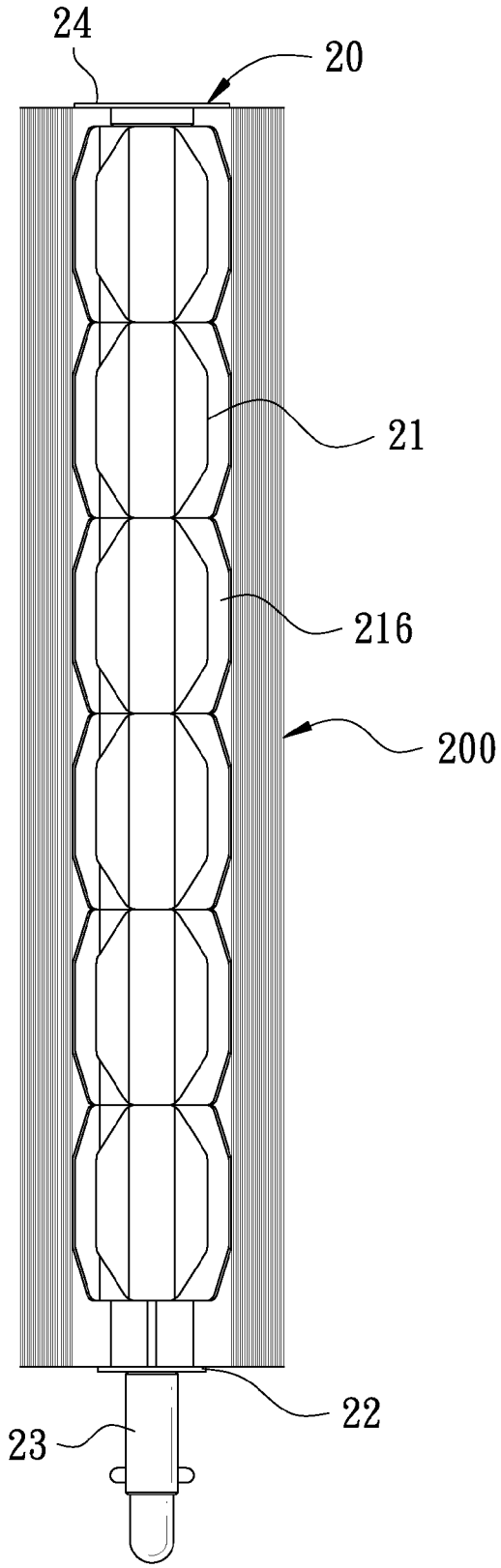
FIG. 6 is a schematic view showing the assembly of the roll of film according to the preferred embodiment of the present invention.
Figure 7:
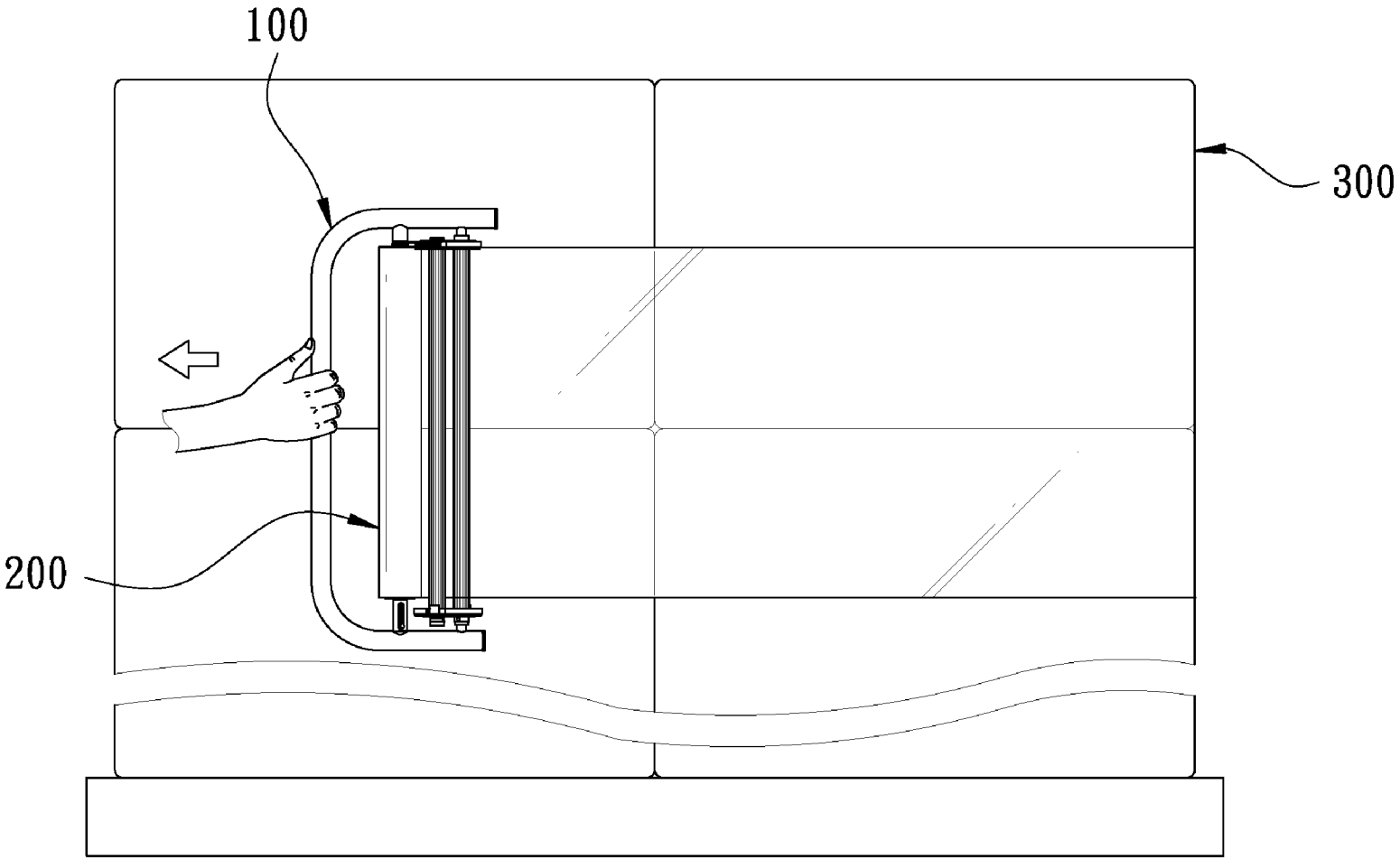
FIG. 7 is a schematic view according to the preferred embodiment of the present invention when in use.

FIG. 6 and FIG. 7 are schematic views showing the present invention when in use. When the user wants to use the film packing device 100, a roll of film 200 which does not have a reel therein is mounted in the film packing device 100. As shown in FIG. 4, the user pulls the limit levers 233 of the quick-release member 23 to pull up the fixing rod 231 towards the axle tube 21, so that the fixing rod 231 disengages from the first positioning hole 111 of the first connection rod 11. The film packing unit 20 is taken out from the handle 10, and then the first rolling member 22 is disengaged from the axle tube 21. As shown in FIG. 7, the roll of film 200 is fitted on the axle tube 21 with the fastening pieces 216 to prop the roll of film 200, achieving a support effect. The first rolling member 22 is then connected to the axle tube 21. As shown in FIG. 5, the pivot block 251 of the pivot member 25 is inserted in the circular trough 243 of the second rolling member 24. As shown in FIG. 4, the fixing rod 231 of the quick-release member 23 is secured in the first positioning hole 111 of the first connection rod 11, such that the roller of film 200 is mounted on the film packing device 100. As shown in FIG. 7, the user uses the film packing device 100 of the present invention to pack an object 300 in a quick, simple and convenient way.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A film packing device comprising, a handle;

the handle having a first connection rod and a second connection rod at two lateral ends ;

a film packing unit and a roller unit being provided between the first connection rod and the second connection rod;

the film packing unit comprising an axle tube, a first rolling member and a second rolling member;

the axle tube having a first positioning portion and a second positioning portion at two ends;

one end of the first rolling member having a first connecting portion corresponding to the first positioning portion of the axle tube to connect with the axle tube, the other end of the first rolling member being connected with a quick-release member;

the first rolling member being pivotally connected to the first connection rod through the quick-release member;

one end of the second rolling member having a second connecting portion corresponding to the second positioning portion of the axle tube to connect with the axle tube, the other end of the second rolling member being connected with a pivot member;

the second rolling member being pivotally connected to the second connection rod through the pivot member;

a roll of film being fitted on the axle tube with the axle tube to provide a support effect for the user to pack an object;

the axle tube being composed of a plurality of sleeves which are connected one by one;

each of the sleeves having the first positioning portion at one end thereof and the second positioning portion at an opposing end thereof;

with the first positioning portion and the second positioning portion , the sleeves being connected together to form the axle tube; and the two ends of the axle tube being formed with the first positioning portion and the second positioning portion, respectively.

2. The film packing device as claimed in claim 1, wherein the first positioning portion of the axle tube is a protruding ring and the first connecting portion of the first rolling member is a trough.

3. The film packing device as claimed in claim 2, wherein the first positioning portion has a positioning block on an outer surface thereof and the first connecting portion has a positioning groove on an inner wall thereof corresponding to the positioning block.

4. The film packing device as claimed in claim 1, wherein the second positioning portion of the axle tube is a trough and the second connecting portion of the second rolling member is a protruding ring.

5. The film packing device as claimed in claim 4, wherein the second positioning portion has a limit groove on an inner wall thereof and the second connecting portion has a limit block on an outer surface thereof corresponding to the limit groove.

6. The film packing device as claimed in claim 1, wherein the first connection rod has a first positioning hole thereon, the end of the first rolling member, opposite to the first connecting portion, having a protruding ring corresponding to the first positioning hole, the protruding ring having two slots thereon, the quick-release member being disposed in the protruding ring, the quick-release member including a fixing rod and a spring which is located between a bottom of protruding ring and the fixing rod, one end of the fixing rod, opposite to the spring, being extended out the protruding ring by the spring and inserted in the first positioning hole, the fixing rod having two limit levers at two sides thereof corresponding to the two slots.

7. The film packing device as claimed in claim 1, wherein the second connection rod has a second positioning hole thereon, the end of the second rolling member, opposite to the second connecting portion, having a circular trough to connect with the pivot member, the pivot member including a pivot block received in the circular trough, the pivot block having a threaded hole for insertion of a pivot rod, one end of the pivot rod, opposite to the pivot block, being provided with a stop block and screwed to the second positioning hole.

* * * * *